US006554400B1

(12) United States Patent
Aoki

(10) Patent No.: US 6,554,400 B1
(45) Date of Patent: Apr. 29, 2003

(54) NOZZLE PLATE AND A MANUFACTURING PROCESS THEREOF

(75) Inventor: Hikoharu Aoki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 697 days.

(21) Appl. No.: 08/867,810

(22) Filed: Jun. 3, 1997

(30) Foreign Application Priority Data

Jun. 5, 1996 (JP) ..... 8-166887

(51) Int. Cl.[7] ..... B41J 2/01
(52) U.S. Cl. ..... 347/47
(58) Field of Search ..... 347/45, 47

(56) References Cited

U.S. PATENT DOCUMENTS 5,208,604 A * 5/1993 Watanabe et al. ..... 347/47
5,538,817 A * 7/1996 Smith et al. ..... 430/5
5,703,675 A * 12/1997 Hirukawa et al. ..... 355/53

* cited by examiner

*Primary Examiner*—John Barlow
(74) *Attorney, Agent, or Firm*—Oliff & Berridge, PLC

(57) ABSTRACT

A nozzle plate is provided with nozzle orifices 2 through which ink is to be ejected, the nozzle orifices 2 being formed by an excimer laser. A manufacturing process for manufacturing the nozzle plate in which the nozzle orifices 2 are formed by the excimer laser uses a working lens having a numerical aperture (NA) set to 0.13 or more and 0.35 or less.

14 Claims, 7 Drawing Sheets

PRIOR ART

NOZZLE PLATE AND A MANUFACTURING PROCESS THEREOF

BACKGROUND OF THE INVENTION

1. Field of the Invention

The present invention relates to a nozzle plate for use in an ink jet type print head and a manufacturing process of the nozzle plate, and more particularly to a nozzle plate provided with nozzle orifices through which ink is to be ejected, the orifices being formed by an excimer laser using a working lens having the numerical aperture set in a range of 0.1 to 0.35, and a manufacturing process of the nozzle plate.

2. Description of Related Art

A nozzle plate used in an ink jet type print head is conventionally provided with minute nozzle orifices through which ink droplets can be ejected, the nozzle orifices being formed by a perforating operation with an excimer laser (for instance, ArF=198 nm, KrF=248 nm, XeKr=308 nm) which emits ultraviolet light. For a working lens used in the perforating operation, the working lens having a numerical aperture (NA) being usually about 0.05 has been used.

This numerical aperture (NA) represents an amount of the performance in connection with brightness and resolving power and the like of an optical system. In engineering instruments, if assuming the angle formed by a radius of an entrance pupil with respect to a point-shaped object (object point) on an optical axis as $\alpha$ and the refractive index of a medium in which the object point exists as "n", the numerical aperture (NA) is represented by n sin $\alpha$.

Here, FIGS. 7 through 9 show the shapes of nozzle orifices formed in the conventional nozzle plate, which are formed by a working lens having NA=0.5. FIG. 7(*a*) is a front view of the conventional nozzle plate and FIG. 7(*b*) is a sectional view of the same. FIG. 8 and FIG. 9 are microphotographs of the nozzle orifices in the conventional nozzle plate.

The conventional nozzle plate 31 is formed of a material having the solution resistance with respect to a solvent included in the constituent of ink to be used, and is provided with many nozzle orifices 32 through which the ink can be ejected as shown in FIG. 7(*a*). FIG. 7(*b*) is a sectional view of the conventional plate 31 in the case where the perforating operation is performed on the nozzle plate 31 by irradiating it with a laser beam from above in the figure. As shown in the figure, the sag (round portion) is produced around the nozzle orifice 32 in the nozzle plate 31 by the perforating operation.

Next, the relation between the size of the sag and the numerical aperture (NA) of the working lens as shown in FIGS. 5(*a*) and 5(*b*), in which the length L of the sag is defined as an amount of sag L ($\mu$m). It is found, as shown in FIG. 5(*a*), that as the sag amount is smaller, the processing precision is higher. As the conventional nozzle plate is subjected to a perforating operation usually using the working lens the numerical aperture (NA) of which is 0.05, the sag amount becomes about 5 $\mu$m as shown in FIG. 5(*b*). The actual shape of the nozzle orifice formed in the conventional nozzle plate in the above manner is shown in FIGS. 8 and 9 which are microphotographs.

For a nozzle plate, it is generally required to reduce the amount of sag to be produced around the ink ejection orifice into 2 $\mu$m or less, which is because a large amount of sag tends to cause the reduction of the speed of ink droplets when ejected and the deflection of ink upon ink ejection, thus resulting in a deterioration in print quality.

Accordingly, in the conventional nozzle plate, a plane thereof on which the laser is incident is adhered to an actuator after the perforating operation. Specifically, the laser incident plane on which sag is produced is adhered to the actuator with an adhesive agent to form a print head in order to raise a processing precision of the nozzle orifice at a side from which ink is to be ejected and thereby to form a stable meniscus of ink. This is because, if the form of the meniscus of ink is unstable, a direction of ink ejecting from the nozzle orifice may become unstable due to a curvature of ink droplet, and variations in the timing of ink ejection may occur, thereby resulting in a deterioration in print quality.

However, there are the following disadvantages in the conventional nozzle plate and the manufacturing process thereof.

The conventional nozzle plate is manufactured such that nozzle orifices are first formed in the nozzle plate by a laser processing operation and, after that, the processed nozzle plate is adhered to an actuator with an adhesive agent. Upon the adhering operation, it is likely that excess adhesive agent flows into the inside of the nozzle orifices. This may cause the nozzle orifices to become unstable in shape and also the meniscus of ink to be unstable. In addition, the nozzle plate is adhered to the actuator after the nozzle orifices are formed, so that it needs to accurately make positioning between the nozzle orifices and the actuator to prevent a positional deflection therebetween. This is because such the positional deflection causes ink ejection in an unstable direction and variations in the timing of ink ejecting. Due to the above disadvantages, an adhering operation requires an extremely high-level and difficult technique.

To the contrary, to prevent the above disadvantages upon the adhering operation, conceivable is a process in which the nozzle plate is first adhered to the actuator and then is subjected to a perforating operation using an excimer laser. In such the case where the perforating operation is performed on the nozzle plate by using an excimer laser after the adhering operation, it is preferable to execute the perforating operation by making a laser beam be incident on a plane of the nozzle plate from which ink is to be ejected. This is because, if the nozzle plate is processed from the side of the plane adhered to the actuator, the energy of the excimer laser incident onto the nozzle plate may weaken the adhesive strength between the nozzle plate and the actuator and deflect the mating position of the nozzle plate and the actuator and, in the worst case, may take the nozzle plate off the actuator.

Accordingly, after the adhering operation, the perforating operation on a nozzle plate is conducted by making the excimer laser be incident onto the plane of the nozzle plate from which ink is to be ejected. In this case, sag is produced on the nozzle orifices at the ink ejecting side, i.e., the surface irradiated by the excimer laser upon the perforating operation. When the perforating operation is performed with the working lens having NA=0.05 as above, the sag amount becomes about 5 $\mu$m as shown in FIG. 5(*b*), which is so large to make a meniscus of ink unstable.

As a result, there are such disadvantages that the ejecting direction of ink ejected from the nozzle orifice becomes unstable due to the curvature of ink droplet, and variations in the timing of ink ejection is produced, resulting in a deterioration in print quality.

As mentioned above, the adhering operation requires a difficult technique when the perforating operation using an excimer laser is performed on the nozzle plate before the nozzle plate is adhered to the actuator, to the contrary, the shapes of the nozzle orifices become unstable when the perforating operation is performed after the adhering operation. Consequently, both ways can not produce a satisfactory processed nozzle plate.

SUMMARY OF THE INVENTION

The present invention has been made in view of the above circumstances and has an object to overcome the above problems and to provide a nozzle plate for an ink jet head provided with nozzle orifices and a manufacturing process of the nozzle plate, capable of reducing sag which will be produced in processing the nozzle plate by an excimer laser device to form the nozzle orifices through which ink can be ejected, of easily adhering the nozzle plate to an actuator and the like, and of forming the nozzle orifices in desired shapes thereby to increase the print quality.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a nozzle plate for an ink jet head of this invention, provided with nozzle orifices through which ink is to be ejected, is characterized in that the nozzle orifices are formed in the nozzle plate by an excimer laser device with a working lens which has a numerical aperture (NA) set to 0.13 or more and 0.35 or less.

In another aspect of the present invention, the nozzle orifices are formed by the excimer laser device with the working lens which has the numerical aperture set to 0.2 or less.

In further aspect of the present invention, a range of the numerical aperture is determined based on size of sag produced around the nozzle orifice and a focal depth of an optical system used in the excimer laser device.

In still further aspect of the present invention, the lowermost value 0.13 in the range of the numerical aperture approximately corresponds to 2 $\mu$m size of the sag.

In still further aspect of the present invention, the uppermost value 0.35 in the range of the numerical aperture approximately corresponds to 1 $\mu$m of the focal depth.

In still further aspect of the present invention, the nozzle orifices are formed on a surface of the nozzle plate from which ink is ejected.

In still further aspect of the present invention, the nozzle orifices are formed in the nozzle plate after the nozzle plate is connected with an actuator for ejecting ink through the nozzle orifices.

In still further aspect of the present invention, the nozzle plate is made of material capable of resisting solvent included in ink.

In still further aspect of the present invention, the material is polyimide resin.

In general, a resolving power R by a projective lens and a focal depth D thereof are calculated based on a numerical aperture of an optical system and a wavelength $\lambda$ of an exposure light, namely, by the following equations; $R=k1\lambda/NA$, $D=\pm k2\lambda/NA2$, where k1 and k2 are constants which are determined depending on materials to be used. Based on the above equations, it is proved that the resolving power R increases in reverse proportion to the NA if the wavelength of the exposure light is fixed, i.e., a processing precision can be made higher by determining the NA larger.

On the other hand, the focal depth D is inversely proportional to NA2. If the NA is increased to make the processing precision higher, the focal depth is reduced, thereby requiring a working technique such as a positioning operation.

The relation between the NA of the optical system and an amount of sag is shown in FIG. 5(*b*).

If the NA of a working lens to be used in processing nozzle orifices by an excimer laser is set to 0.13 or more, resolving power become better, so that the nozzle orifices can be processed without producing sag therein. As shown in FIG. 5(*b*), when NA is 0.13, for example, the amount of sag is about 2 $\mu$m. In the case where the amount of sag is 2 $\mu$m or less, there is no problem in nozzle orifices to be used. It is therefore preferable that the NA is 0.13 or more in view of the amount of sag.

Subsequently, the relation between the NA of the optical system and the focal depth is shown in FIG. 6. If the NA is set to larger, the focal depth is further reduced. When the NA is 0.15, for example, the focal depth becomes about 5 $\mu$m. In this way, the reduced focal depth makes the positioning operation in a processing operation more difficult. The focal depth becomes about 1 $\mu$m when the NA is 0.35. If the focal depth is further reduced than that value, the positioning operation becomes extremely difficult. It is therefore preferable that the NA is 0.35 or less in view of the focal depth. More preferably, the NA is 0.2 or less at which the focal depth becomes 3 $\mu$m or more.

Further, if the NA is set in a range of 0.13 to 0.35, the amount of sag at a laser irradiated plane of the nozzle plate is reduced to the level causing no trouble in use, so that there is no problem in that the laser irradiated plane is used for an ink ejecting plane. Accordingly, after the nozzle plate is adhered to an actuator, a perforating operation can be executed on the nozzle plate by making an excimer laser beam be incident the plane from which the ink is to be ejected. This makes it possible to prevent the disadvantages such as the difficult positioning and the flowing of an adhesive agent into the nozzle orifices upon the adhering operation.

Based on the above points, it is possible to easily form nozzle orifices having clear shapes and make the form of a meniscus stable, so that no variation occur in the ejecting direction of the ink ejected from the nozzle orifices and the timing of ink ejection. Consequently, a print head using the nozzle plate according to the present invention enables to achieve printing with a high print quality.

Furthermore, a manufacturing process of the present invention, for manufacturing a nozzle plate for an ink jet head provided with nozzle orifices though which ink is to be ejected, is characterized in that an excimer laser device with a working lens which has a numerical aperture (NA) set to 0.13 or more and 0.35 or less is utilized for forming the nozzle orifices in the nozzle plate.

In another aspect of the present invention, the excimer laser device with the working lens which has the numerical aperture set to 0.2 or less is utilized for forming the nozzle orifices.

In further aspect of the present invention, a range of the numerical aperture is determined based on size of sag produced around the nozzle orifice and a focal depth of an optical system used in the excimer laser device.

In still further aspect of the present invention, the lowermost value 0.13 in the range of the numerical aperture approximately corresponds to 2 $\mu$m size of the sag.

In still further aspect of the present invention, the uppermost value 0.35 in the range of the numerical aperture approximately corresponds to 1 μm of the focal depth.

In still further aspect of the present invention, the nozzle orifices are formed on a surface of the nozzle plate from which ink is ejected.

In still further aspect of the present invention, the nozzle orifices are formed in the nozzle plate after the nozzle plate is connected with an actuator for ejecting ink through the nozzle orifices.

According to the manufacturing process of the present invention, the nozzle plate having nozzle orifices complete in shape can easily be manufactured. Because of the stable form of a meniscus of ink, no variation occur in the ejecting direction of ink to be ejected from the nozzle orifices and the timing of ink ejection. As a result, a print head using the nozzle plate manufactured by the above process according to the present invention can conduct a printing operation with an excellent print quality.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings, FIG. 1(*a*) is a front view of a nozzle plate in an embodiment of the present invention;

FIG. 5(*b*) is a graph showing a relation between a numerical aperture (NA) of a working lens and the amount of sag;

FIG. 7(*b*) is a sectional view of the nozzle plate of FIG. 7(*a*);

DETAILED DESCRIPTION OF THE PREFERRED EMBODIMENTS

A detailed description of one preferred embodiment of a nozzle plate and a manufacturing process thereof embodying the present invention will now be given referring to the accompanying drawings.

Figure 1:
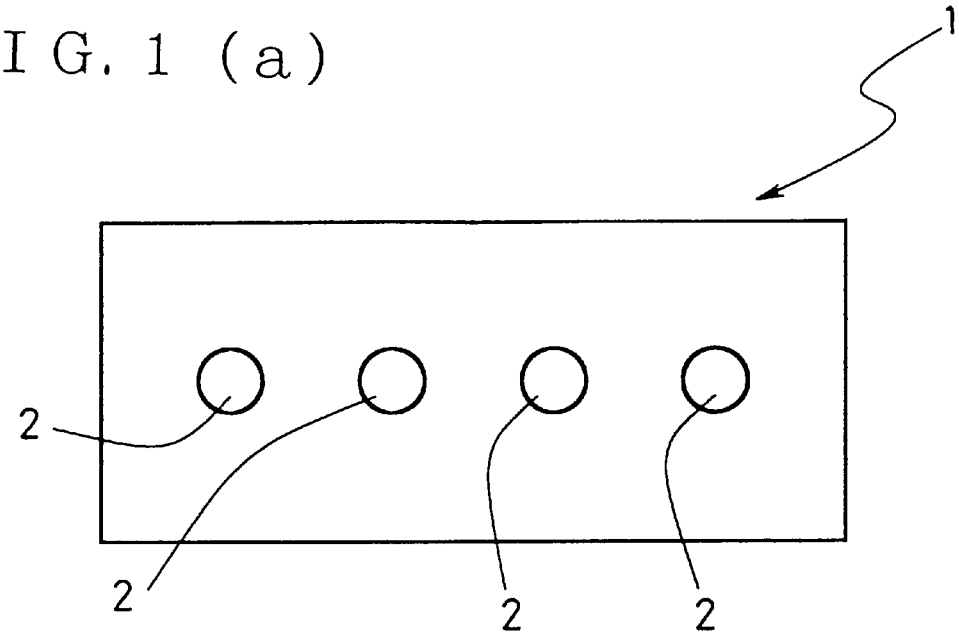
FIG. 1(*b*) is a sectional view of the nozzle plate of FIG. 1(*a*)
Figure 1:
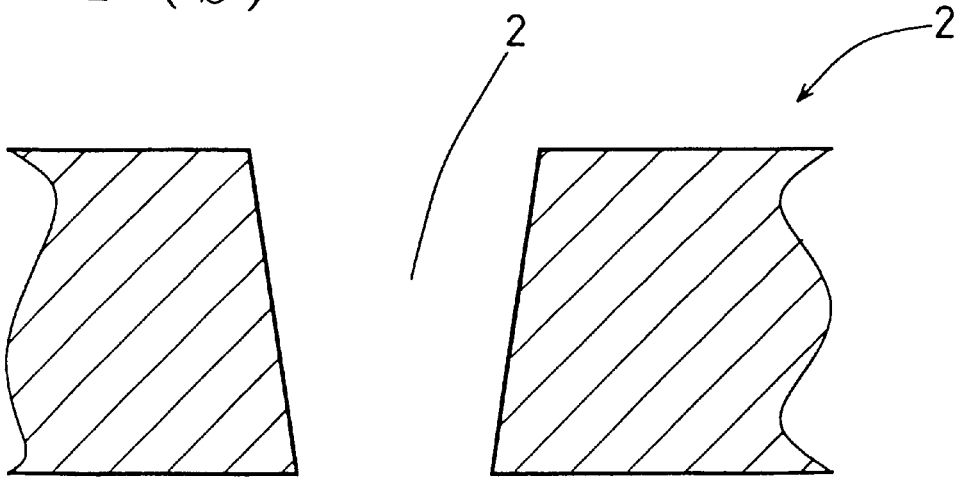
Figure 2:
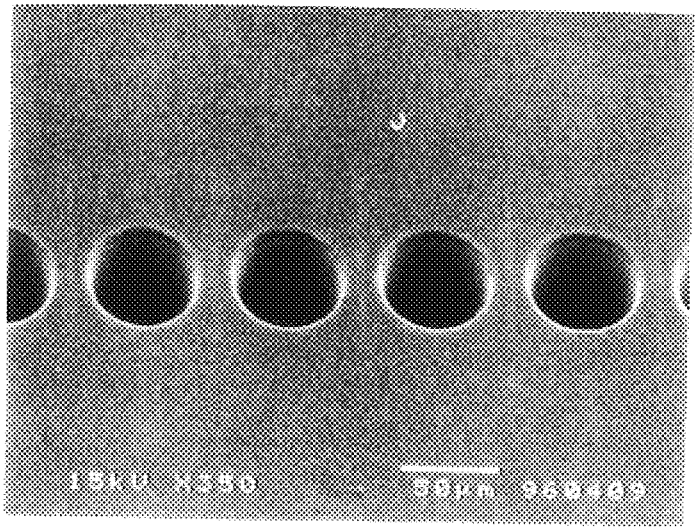
FIG. 2 is a microphotograph of nozzle orifices observed with a 350-power microscope in the embodiment, in which nozzle orifices are formed by a working lens with a numerical aperture (NA) being 1.5.
Figure 3:
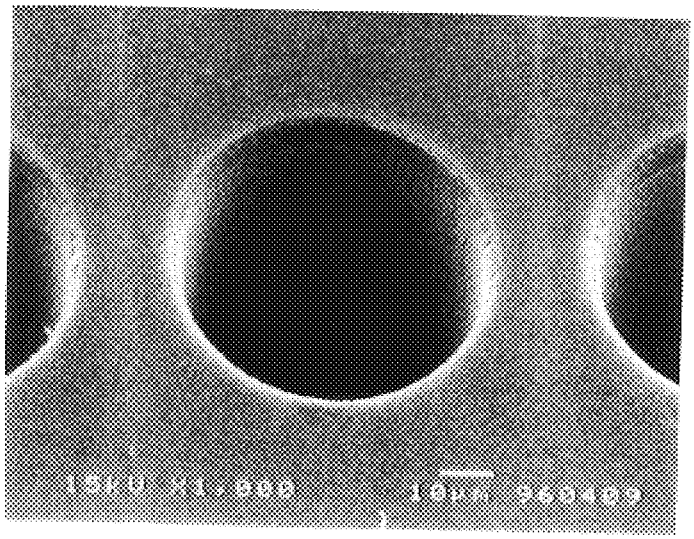
FIG. 3 is a microphotograph of nozzle orifices observed with a 1000-power microscope in the embodiment, in which nozzle orifices are formed by a working lens with a numerical aperture (NA) being 1.5.

FIG. 1 through FIG. 3 show a nozzle plate in the embodiment according to the present invention. FIG. 1(*a*) is a front view of the nozzle plate and FIG. 1(*b*) is a sectional view of the same FIG. 2 and FIG. 3 are microphotographs that photographed nozzle orifices formed in the nozzle plate by means of a working lens with a numerical aperture (NA) being 0.15.

In the nozzle plate 1 are formed, as shown in FIGS. 1(*a*) and 1(*b*), in a line many nozzle orifices 2 through which ink is ejected toward an appropriate position.

This nozzle plate 1 is formed of a material having the resistance to solution with respect to a solvent included in the constituent of ink which is to be used. For example, used is a polyimide resin being 75 μm in thickness in the present embodiment, but it is not limited thereto. If only having the resistance to solution with respect to a solvent included in the ink to be used and capable of being perforated by means of an excimer later, any material can be used, for instance, thermosetting resin.

Meanwhile, a perforating operation onto the nozzle plate 1 is explained with reference to FIG. 4.

Figure 4:
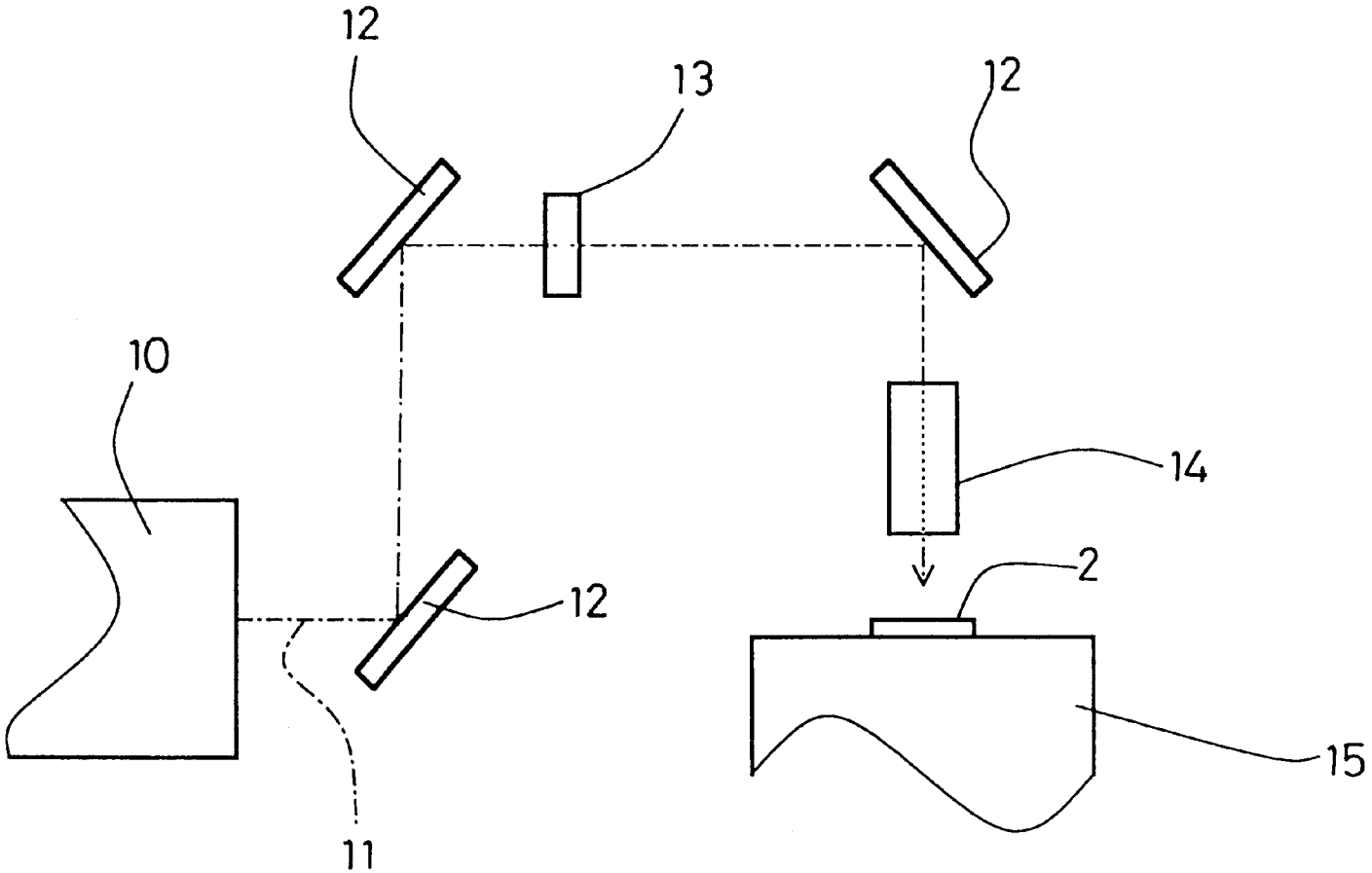
FIG. 4 is a schematic view showing an apparatus of a laser device for perforating a nozzle plate.

In FIG. 4, a laser device for performing a perforating operation on a nozzle plate is schematically constructed of a laser generator 10, a plurality of bend mirrors 12, a mask 13 provided with an opening (not shown) which is similar in shape to the desired shape of the resulting nozzle orifices, and a working lens 14.

With the above laser device, an excimer laser beam 11 emitted from the laser generator 10 is bent by the bend mirrors 12, passes through the mask 13, and is further bent by the bend mirror 12 toward the working lens 14. Through the working lens 14, the laser beam 11 forms an image of a mask-shape on the nozzle plate 1 placed on a working table 15, thereby to form nozzle orifices 2.

Here, before the nozzle plate 1 is set on the working table 15, the nozzle plate 1 is at first connected with an actuator with an adhesive agent. After that, the nozzle plate 1 is placed with the surface of an ink ejecting side up on the working table 15. The laser beam 11 forms the image of the mask on the nozzle plate 1 in the above manner. In this way, a perforating operation is conducted on the nozzle plate 1 by making the laser beam 11 be incident from the side of the ink ejecting surface of the nozzle plate 1.

In the present embodiment, for the excimer later beam 11, used is a KrF excimer laser which emits a laser beam having a wavelength of 248 nm, the energy density in a processing point is 800 mJ/cm$^2$. The mask 13 is provided with a hole being 300 μm in diameter. The working lens 14 is a lens having a one fifth reduction ratio. Accordingly, each diameter of the nozzle orifices 2 becomes 60 μm. Those conditions are needed to be appropriately determined according to the shape of a nozzle.

Figure 5:
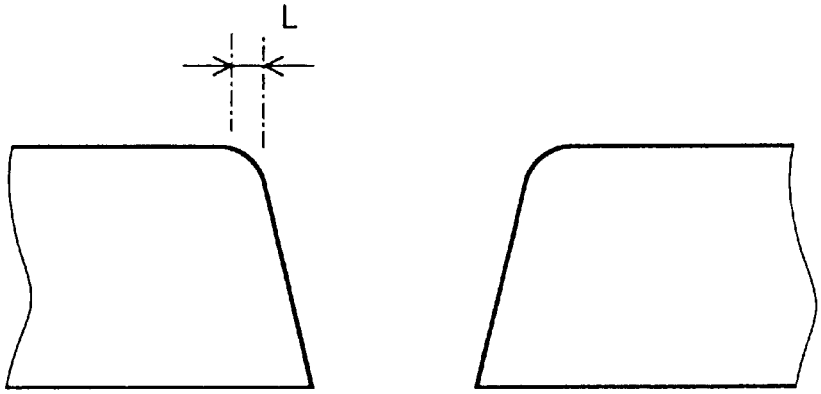
FIG. 5(*a*) is an explanatory view using a sectional view of a nozzle plate to define an amount of sag produced around a nozzle orifice.
Figure 5:
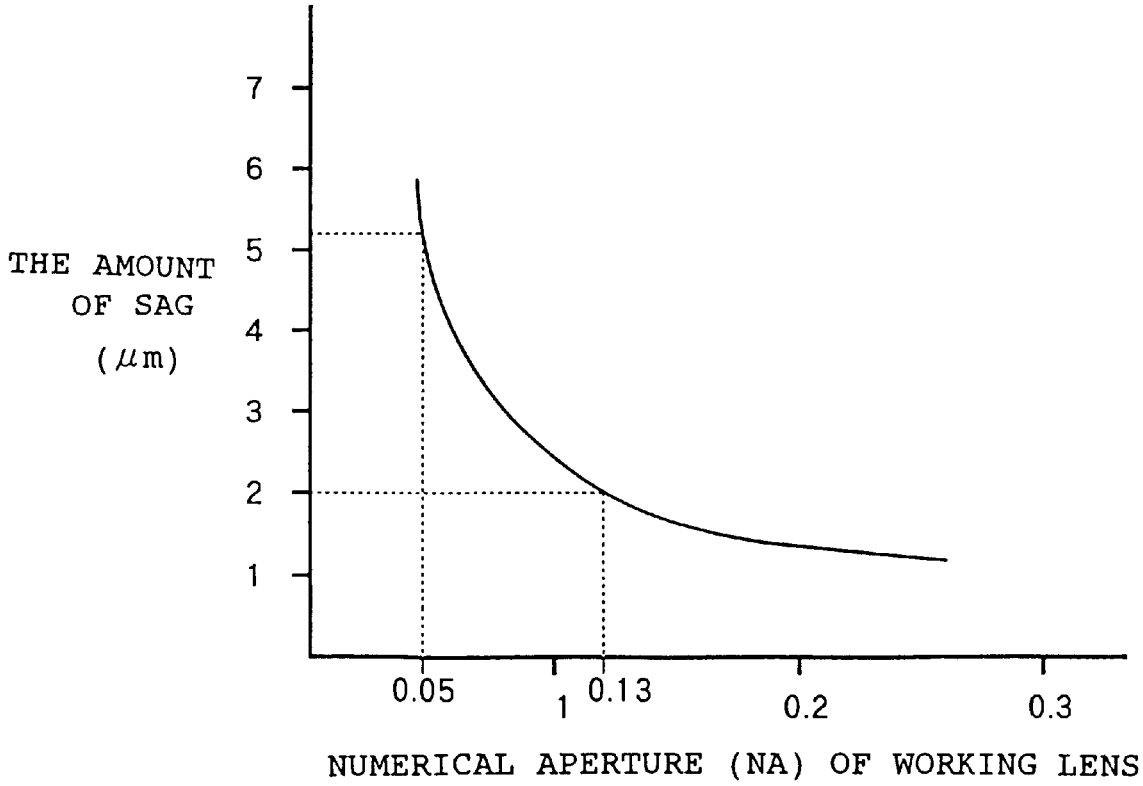

Subsequently, the definition of the amount of sag is shown in FIG. 5(*a*) and the relation between NA of the working lens 14 and the amount of sag is shown in a graph of FIG. 5(*b*). The amount of sag means a working precision quantatively represented by a length L as shown in FIG. 5(*a*). As the amount of sag is smaller, the working precision is higher.

On the other hand, it is proved from the graph of FIG. 5(*b*) that the amount of sag becomes smaller as NA of the working lens 14 is larger, and it is sufficient to set the working lens 14 to have the NA being 0.13 or more because there is no problem in a using precision if the amount of sag is 2 μm or less.

Figure 6:
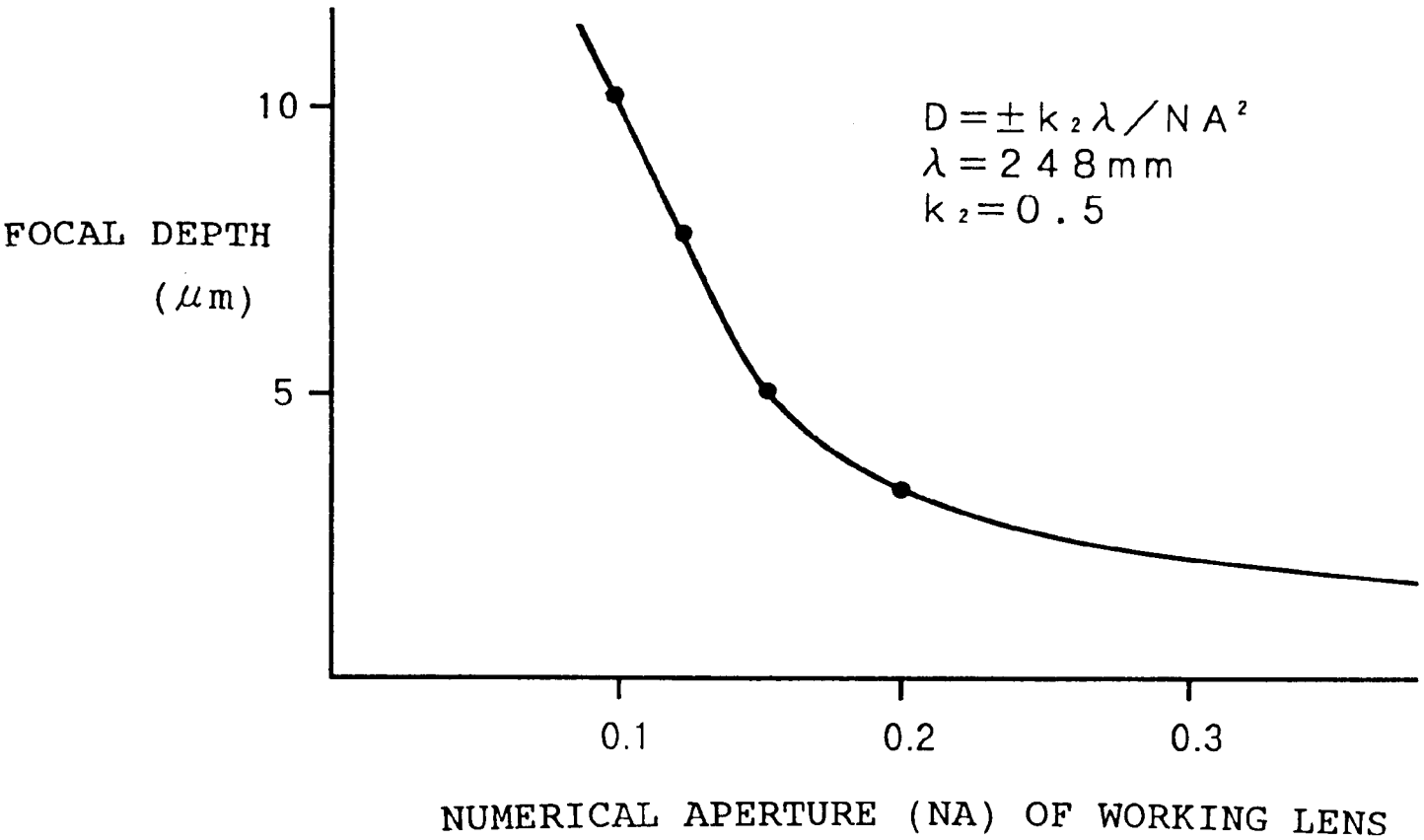
FIG. 6 is a graph showing a relation between the numerical aperture (NA) of a working lens and a depth of focus.
Figure 7:
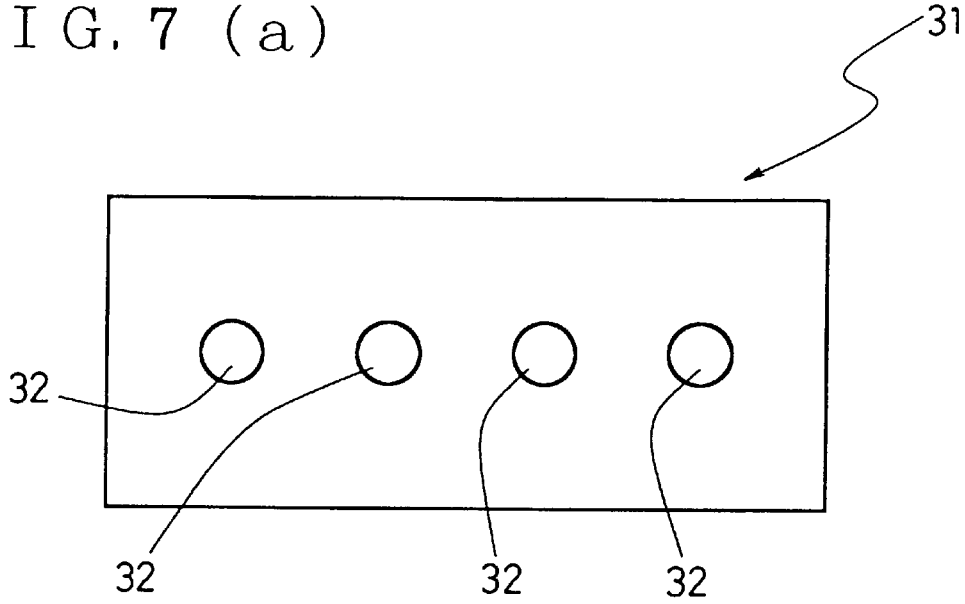
FIG. 7(*a*) is a front view of a nozzle plate in the prior art.
Figure 7:
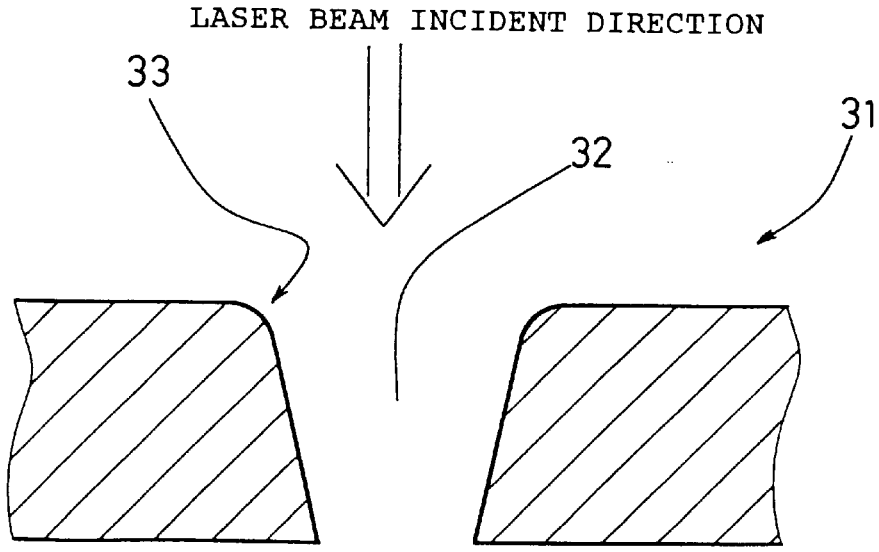
PRIOR ART FIG. 7 (b)

Further, the relation between the NA of the working lens 14 and the depth of focus is shown in FIG. 6, where the depth of focus means the area of an image plane in an optical direction in which clear image can be obtained at front and behind of a focal plane.

It is proved from this graph that the focal depth is further reduced as the NA is larger. Considering a working technique where positioning upon a working operation becomes difficult as the focal depth is further reduced, the focal depth is needed to be 1 μm or more, more preferably to 3 μm or more, so that the NA of the working lens 14 is set to 0.35 or less, more preferably to 0.2 or less.

In consideration of the amount of sag and the focal depth, it is preferable to set the NA of the working lens 14 to 0.13 or more and 0.35 or less, more preferably to 0.13 or more and 0.2 or less. In the embodiment, the working lens 14 with NA=0.15 is used, accordingly.

Figure 8:
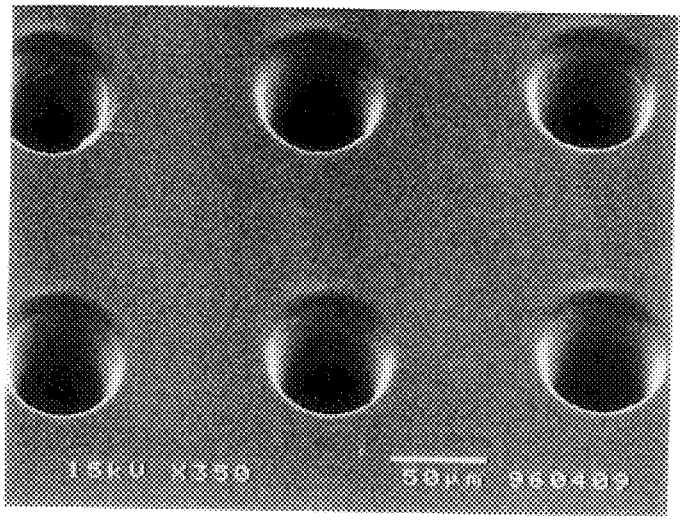
FIG. 8 is a microphotograph of nozzle orifices observed with a 350-power microscope in the prior art, in which nozzle orifices are formed by a conventional manufacturing process using a working lens with a numerical aperture (NA) being 0.05.
Figure 9:
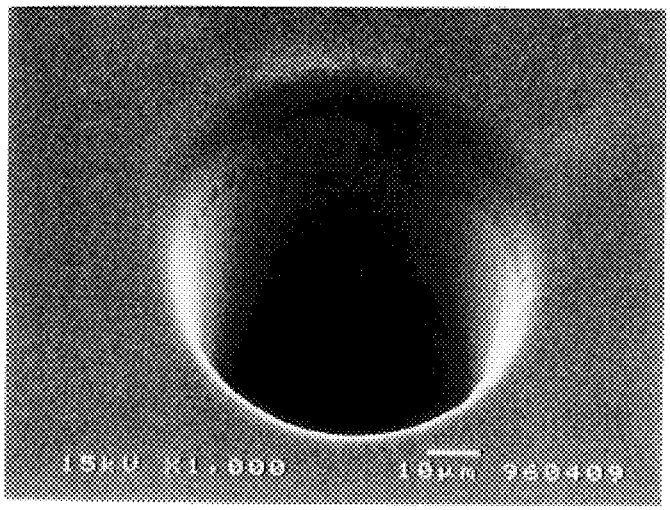
FIG. 9 is a microphotograph of nozzle orifices observed with a 1000-power microscope in the prior art, in which nozzle orifices are formed by a conventional manufacturing process using a working lens with a numerical aperture (NA) being 1.5.

Shown in FIGS. 2 and 3 are the nozzle orifices 2 formed by a laser processing operation using the working lens 14 with NA=0.15. It is seen that the nozzle orifices 2 are complete in shape due to reduced sag compared to the nozzle orifices in the conventional nozzle plate shown in FIGS. 8 and 9.

As explained above, according to the nozzle plate 1 in the present embodiment, small is the sag produced when the nozzle orifices 2 through which ink is ejected are formed on the nozzle plate 1 by an excimer laser, so that the form of a meniscus of ink can be made stable, thereby preventing an ejecting direction of ink to be ejected from the nozzle orifices 2 from becoming unstable due to the curvature of ink droplet and the ejecting timing of ink from becoming inconstant. As a result thereof, it is possible to perform printing capable of offering a high print quality.

Further, according to a manufacturing process of the nozzle plate 1 in the present embodiment, the sag produced when the nozzle orifices 2 through which ink is ejected are formed on the nozzle plate 1 by an excimer laser is reduced, so that the nozzle orifices 2 can be formed with a high precision. This manufacturing process makes it possible to perforate the nozzle plate 1 from the ink ejecting direction, so that the perforating operation can be conducted even after the nozzle plate 1 is adhered to the actuator. While preventing the occurrence of the disadvantages having occurred when the nozzle plate 1 was adhered to the actuator in a manufacturing process of a print head, such as the flowing of the adhesive agent into the nozzle orifices 2 and the difficulty in positioning between the nozzle plate 1 and the actuator, the nozzle orifices 2 can be formed with a high precision.

In the above way, the nozzle plate 1 can be manufactured, which is capable of providing a high print quality.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A nozzle plate for an ink jet head provided with nozzle orifices through which ink is to be ejected, wherein the nozzle orifices are formed in the nozzle plate by an excimer laser device with a working lens which has a numerical aperture (NA) set to 0.13 or more and 0.35 or less, wherein the range of the numerical aperture is determined based on size of a round portion produced around the nozzle orifice and a focal depth of an optical system used in the excimer laser device, and wherein the value 0.13 is selected so that an amount of the round portion becomes lower than a predetermined amount and approximately corresponds to 2 μm size of the round portion, and the value 0.35 is selected so that the nozzle plate and the working lens are easily positioned when the nozzle orifices are formed by the excimer laser device.

2. A nozzle plate according to claim 1, wherein the nozzle orifices are formed by the excimer laser device with the working lens which has the numerical aperture set to 0.2 or less.

3. A nozzle plate according to claim 1, wherein the uppermost value 0.35 in the range of the numerical aperture approximately corresponds to 1 μm of the focal depth.

4. A nozzle plate according to claim 1, wherein the nozzle orifices are formed on a surface of the nozzle plate from which ink is ejected.

5. A nozzle plate according to claim 4, wherein the nozzle orifices are formed in the nozzle plate after the nozzle plate is connected with an actuator for ejecting ink through the nozzle orifices.

6. A nozzle plate according to claim 1, wherein the nozzle plate is made of material capable of resisting solvent included in ink.

7. A nozzle plate according to claim 6, wherein the material is polyimide resin.

8. A manufacturing process for manufacturing a nozzle plate for an ink jet head provided with nozzle orifices though which ink is to be ejected, wherein an excimer laser device with a working lens which has a numerical aperture (NA) set to a range of 0.13 or more and 0.35 or less is utilized for forming the nozzle orifices in the nozzle plate, wherein the range of the numerical aperture is determined based on size of a round portion produced around the nozzle orifice and a focal depth of an optical system used in the excimer laser device, and wherein the value 0.13 is selected so that an amount of the round portion becomes lower than a predetermined amount, and the value 0.35 is selected so that the nozzle plate and the working lens are easily positioned when the nozzle orifices are formed by the excimer laser device.

9. A manufacturing process according to claim 8, wherein the excimer laser device with the working lens which has the numerical aperture set to 0.2 or less is utilized for forming the nozzle orifices.

10. A manufacturing process according to claim 8, wherein the lowermost value 0.13 in the range of the numerical aperture approximately corresponds to 2 μm size of the sag the round portion.

11. A manufacturing process according to claim 8, wherein the uppermost value 0.35 in the range of the numerical aperture approximately corresponds to 1 μm of the focal depth.

12. A manufacturing process according to claim 8, wherein the nozzle orifices are formed on a surface of the nozzle plate from which ink is ejected.

13. A manufacturing process according to claim 12, wherein the nozzle orifices are formed in the nozzle plate after the nozzle plate is connected with an actuator for ejecting ink through the nozzle orifices.

14. A nozzle plate for an ink jet head provided with nozzle orifices through which ink is to be ejected, wherein the nozzle orifices are formed in the nozzle plate by an excimer laser device with a working lens which has a numerical aperture (NA) set to 0.13 or more and 0.35 or less, wherein the range of the numerical aperture is determined based on size of a round portion produced around the nozzle orifice and a focal depth of an optical system used in the excimer laser device, and wherein the value 0.13 is selected so that an amount of the round portion becomes lower than a predetermined amount, and the value 0.35 is selected so that the nozzle plate and the working lens are easily positioned when the nozzle orifices are formed by the excimer laser device and approximately corresponds to 1 $\mu$m of the focal depth.

* * * * *